US005125936A

United States Patent [19]

Johansson

[11] Patent Number: 5,125,936

[45] Date of Patent: Jun. 30, 1992

[54] EMISSION ELECTRODE

[75] Inventor: Harry Johansson, Skellefteå, Sweden

[73] Assignee: Boliden Contech AB, Stockholm, Sweden

[21] Appl. No.: 601,731

[22] PCT Filed: Jun. 1, 1989

[86] PCT No.: PCT/SE89/00309

§ 371 Date: Oct. 31, 1990

§ 102(e) Date: Oct. 31, 1990

[87] PCT Pub. No.: WO89/11913

PCT Pub. Date: Dec. 14, 1989

[30] Foreign Application Priority Data

Jun. 3, 1988 [SE] Sweden ..... 88020722

[51] Int. Cl.[5] ..... B03C 3/00

[52] U.S. Cl. ..... 55/152; 55/148

[58] Field of Search ..... 55/152, 148; 361/225-235

[56] References Cited

U.S. PATENT DOCUMENTS

| | | | |
|---|---|---|---|
| 1,980,521 | 11/1934 | Hahn | 361/230 |
| 2,127,229 | 8/1938 | McRae | 361/230 |
| 2,894,175 | 7/1959 | Lamm | 361/228 |
| 3,120,626 | 2/1964 | Schwernier | 361/230 |
| 3,483,671 | 12/1969 | Wiemer | 55/152 |
| 3,619,719 | 11/1971 | Waller et al. | 361/230 |
| 4,126,434 | 11/1978 | Kellichi et al. | 55/152 |
| 4,673,417 | 6/1987 | Goransson et al. | 55/152 |

FOREIGN PATENT DOCUMENTS

| | | | |
|---|---|---|---|
| 218450 | 11/1957 | Australia . | |
| 266515 | 6/1963 | Australia . | |
| 452955 | 1/1988 | European Pat. Off. . | |
| 2601358 | 3/1977 | Fed. Rep. of Germany . | |
| 854816 | 11/1960 | United Kingdom | 55/152 |

*Primary Examiner*—Bernard Nozick

*Attorney, Agent, or Firm*—Burns, Doane, Swecker & Mathis

[57] ABSTRACT

The invention relates to an emission electrode (10) for use in an electrostatic precipitator, in combination with one or more collector electrodes, wherein the emission electrode includes a carrier bar (11) and a plurality of electrode elements (12). One end-part of respective electrode elements (12) is connected to the peripheral surface of the carrier bar (11) in the absence of a gap therebetween, and in a manner such that the electrode elements will project from the peripheral surface of the carrier bar in a number of mutually different directions. The free-end or tip of respective electrode elements has a pyramidal or conical configuration (13) and the shank-part (15) of the electrode elements is advantageously screw-threaded. The end-parts of the carrier bar (11) are provided with means (16) for attachment of the emission electrode to holder devices. The inventive emission electrode is highly efficient and can be manufactured and handled in a very rational and effective manner.

14 Claims, 4 Drawing Sheets

EMISSION ELECTRODE

AN EMISSION ELECTRODE

FIELD OF THE INVENTION

The present invention relates to an emission electrode for use in an electrostatic precipitator, in combination with one or more collector electrodes, said emission electrode including a carrier bar and a number of electrode elements.

BACKGROUND OF THE INVENTION

Emission electrodes intended for electrostatic precipitators will preferably exhibit a number of essential properties, such as high mechanical strength and rigidity, infrequent service requirements, high corrosion resistance and high efficiency, and will be capable of being manufactured and handled in a rational and efficient manner.

Electrostatic precipitators are used, for instance, to cleanse media in the form of, for instance, dust-laden gases eminating from sulphuric-acid production processes, metal smelting processes, cement manufacturing plants and incinerators.

Electrostatic precipitators can be constructed to cleanse both dry and moist gases from the dust carried thereby. Dry-gas precipitators are normally constructed for horizontal gas-throughflow, whereas moist-gas precipitators are normally constructed for vertical gas-throughflow.

In addition to the aforesaid emission electrodes, such electrostatic precipitators also include collector electrodes. A voltage source is provided for creating a potential difference between the emission electrodes and the collector electrodes, so as to generate an electric field between said electrodes in an area through which the dust-laden gas flows, the dust particles being caused primarily to settle on the collector electrodes, such that the gas exiting from the precipitator will be essentially free from dust particles.

The voltage applied in the case of such precipitators is preferably a direct voltage which preferably lies at the sparkover limit, i.e. such as to obtain the highest possible electric field-strength at which a corona effect and glowing-discharge will take place, therewith to provide the maximum precipitating force on the discrete dust particles and consequently to achieve the highest possible gas-cleansing effect.

Various kinds of such so-called rigid emission-electrodes are known to the art, all of which have a number of different drawbacks: These drawbacks are eliminated to a large extent by means of the inventive emission electrode.

OBJECT AND SUMMARY OF THE INVENTION

Thus, it is desired to configure the electrode elements of the emission-electrode in a manner which will stimulate the glow-discharge and corona-effect, while at the same time eliminating cavitational corrosion between the electrode elements and the carrier bar carrying said elements. Furthermore, the configuration of said electrode elements should be such as to enable the emission electrodes to be manufactured and handled in a rational fashion. The emission electrodes will preferably also require solely the minimum of service and will be highly efficient.

The object of the present invention is to provide an emission electrode which will fulfill the aforesaid requirements to a large degree.

BRIEF DESCRIPTION OF THE DRAWINGS FIGURES

An exemplifying embodiment of the invention will now be described in more detail with reference to the accompanying drawings in which FIG. 1 is a perspective view of an electrode frame constructed from a plurality of inventive emission electrodes; FIG. 2 is a perspective view of one embodiment of an inventive emission electrode; FIG. 3 is a perspective view of a further embodiment of an inventive emission electrode; and FIG. 4 illustrates a number of emission electrodes stacked together in a storage and transport position.

DETAILED DESCRIPTION OF THE PREFERRED EMBODIMENTS

Figure 1:
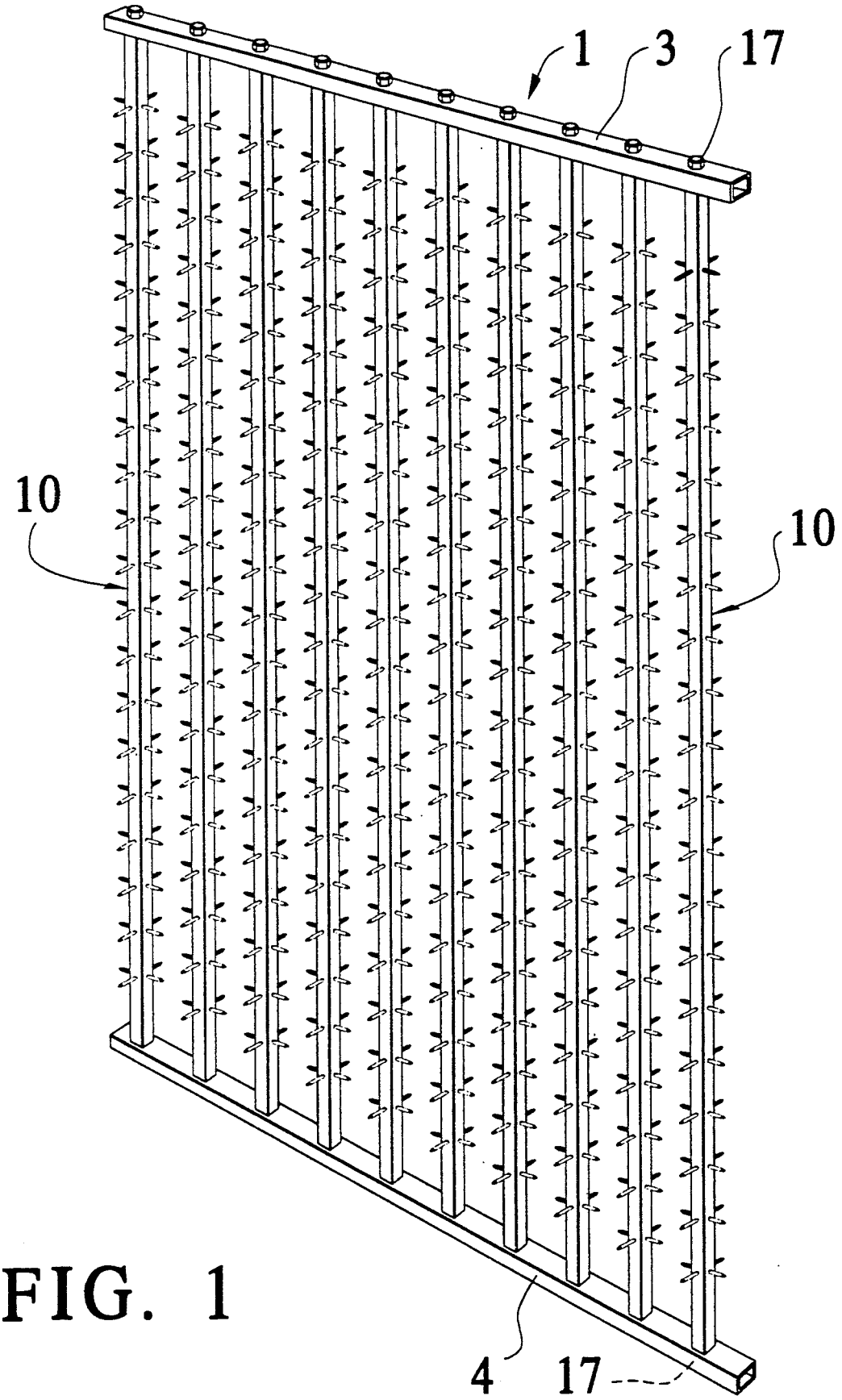

FIG. 1 illustrates an electrode frame 1 which includes a group of inventive electrodes 10 the ends of which are attached to a respective upper 3 and lower 4 holder device, wherein the frame 1 is intended to be mounted in one part of an electrostatic precipitator which is through-passed by dust-laden gas to be cleansed from its dust content. One or more frames 1 co-act with one or more collector electrodes provided in the precipitator, by generating an electric field between the emission electrodes and the collector electrodes, such that dust particles will primarily settle on the collector electrodes and therewith cleanse the dust-laden gas.

Figure 2:
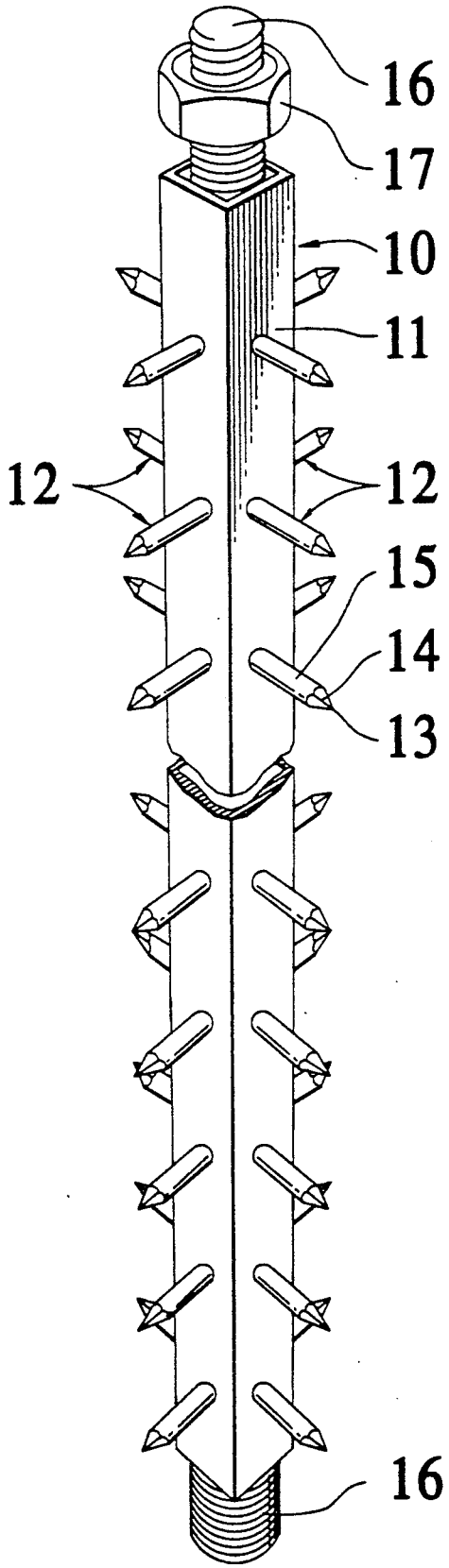

FIG. 2 illustrates an inventive emission electrode 10 dismantled from the frame 1. The electrode 10 includes a carrier bar 11 on which a plurality of electrode elements 12 are mounted.

The carrier bar 11 of the illustrated embodiment comprises a hollow bar of square cross-section, although it will be understood that said bar may have a round cross-section or any other cross-sectional shape. Furthermore, the carrier bar may be solid, instead of hollow. In order to provide for a favourable corona effect, the electrode elements 12 preferably have a pyramidal tip 13, the defining edges 14 of the pyramidal configuration of the tips 13 also contributing to high efficiency of the electrode element 12. The shank-part 15 of the electrode element 12 of the illustrated embodiment has a round cross-section, although it will be understood that said shank-part may have a cross-sectional shape other than round. It will also be understood that the tip 13 of the electrode element may be conical.

As will be seen from FIG. 2, a number of electrode elements 12 are mounted on the carrier bar 11 such that said electrode elements project from the carrier bar in four mutually different directions.

It will be understood, however, that it lies within the purview of the invention for the electrode elements 12 to project in any desired number of directions from the carrier bar 11, i.e. from one direction to a plurality of mutually different directions, this being possible, for instance, when the carrier bar has a round cross-section. This configuration, however, detracts from certain handling advantages.

According to the invention, the electrode elements 12 are preferably attached to the carrier bar 11 by means of so-called stud-welding techniques, which ensures gap-free connection between the electrode elements 12 and the carrier bar 11, therewith effectively eliminating the risk of cavitational corrosion.

The afore-mentioned method of attaching the electrode elements to the carrier bar also enables manufacture of the emission electrodes to be highly automated.

Naturally, other welding methods in which one end-part of respective electrode elements is fused or otherwise connected to the carrier bar such as to form a gap-free connection can be applied when manufacturing the inventive emission electrodes.

Mounted on respective ends of the emission electrode 10 of the illustrated embodiment is a screw-threaded stud 16 which is intended to pass through a respective hole in the holding devices 3 and 4, the emission electrodes 10 in this case being secured to the holding devices by means of nuts 17.

It will be understood that the inventive emission electrodes can be secured to the holder devices in a number of ways different from that illustrated. For instance, the ends of the carrier bar 11 may be flattened, in which case the emission electrodes can be secured to said holder devices with the aid of suitable fastener means, for instance a screw passing through said flattened ends.

Figure 3:
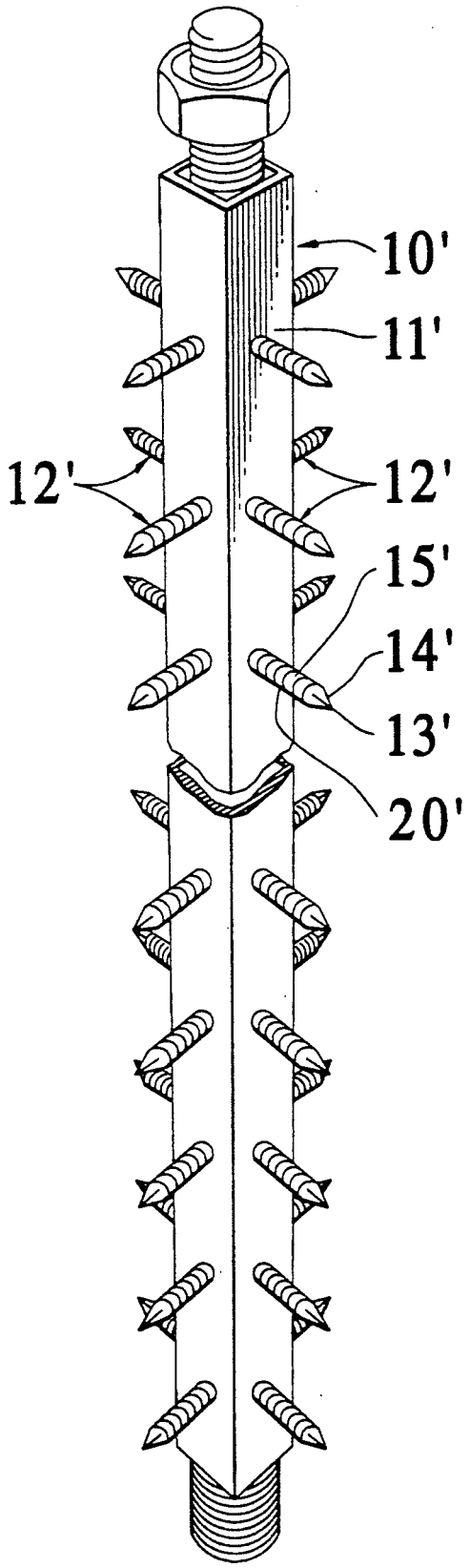

FIG. 3 illustrates an alternative embodiment of an inventive emission electrode, which is referenced 10' and the electrode elements 12' of which are a different configuration than the electrode elements described above. Similar to the electrode element 12, the electrode 12' has a pyramidal tip 13' exhibiting pyramid-defining edges 14', and also comprises a shank-part 15' of round cross-section provided with a screw-thread 20', the tip of the screw-thread favourably influencing the efficiency and corona-forming ability of the emission electrode.

In the normal position of use of the emission electrode, the carrier bar extends vertically, as illustrated in FIG. 1–3, and consequently the longitudinal axes of the electrode elements are horizontally located. The therewith substantially vertically arranged grooves of the screw-threads 20' provide a satisfactory electrode function, even, for instance, in the presence of moisture, since any droplet formation that occurs will be concentrated solely on the part of the screw-thread located on the underside of the electrode elements, thereby enabling a large part of the screw-thread to function in the manner intended, despite the presence of moisture. It should also be noted that when the vertically arranged emission-electrodes operate in dry environments, the dust particles will readily leave the grooves of the screw-threads, since these grooves extend substantially vertically, therewith enabling the corona-stimulating function of the screw-thread to be maintained over a long period of time.

It will also be noted that the tips 13; 13' of the electrode element is important both with respect to achieving maximum corona-formation and with respect to the prevention of dust-coatings on the electrode element itself. As a result of the particular configuration of the inventive electrode elements, the dust-coating on the emission electrode 10; 10, will be concentrated in the vicinity of the carrier bar 11; 11', and consequently the intervals between those times when it is necessary to clean the electrodes will be relatively long.

Figure 4:
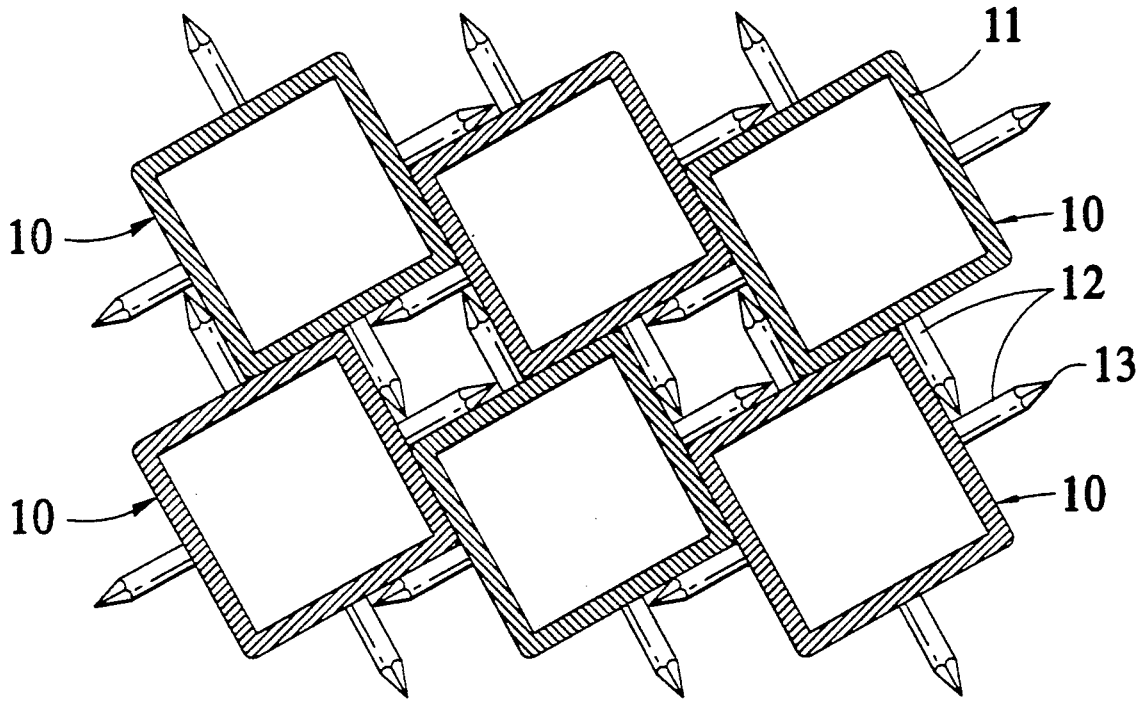

FIG. 4 illustrates the possibility of stacking together the inventive emission electrodes 10 in a particularly space-saving fashion when, for instance, storing and transporting the electrodes, this stacking configuration enabling the conical or pyramidal tips 13 of the electrode elements 12 to be shielded against mechanical damage. The illustrated stacking configuration also protects effectively the screw-threads 20' of the electrode-element embodiment provided with such screw-threads, since when stacked in the illustrated manner only the outer defining part of the sides of respective electrode elements are in contact with the peripheral surface of the carrier bar 11', while remaining parts of said side-surfaces remain well-protected and therewith intact. The aforesaid packing advantages are obtained because the length of respective electrode elements is shorter than the width-dimension or the diameter of the carrier bar, although, at the same time, it may be necessary to displace the emission electrodes axially in relation to one another. Naturally, the peripheral parts of the stacked electrode-pack must be packaged in a satisfactory manner, for instance with the aid of wooden packing slats or the like.

It will be understood that the electrode elements 12; 12' need not necessarily be positioned in the manner illustrated in the Figures, but that said electrode elements on one side of the carrier bar 11; 11, can be displaced in relation to the electrode elements on another side of said carrier bar.

Furthermore, it will be understood that the positioning of the emission electrodes in the flow of dust-laden medium is not restricted to said vertical position, but that any desired position or orientation is possible.

It will also be understood that the carrier bar shall be dimensioned so that the emission electrode will be sufficiently rigid or stiff for the application for which it is intended.

The invention is not described to the illustrated and described embodiments and modifications and changes can be made within the scope of the following claims.

I claim

1. An emission electrode for use in an electrostatic precipitator, in combination with at least one collector electrode, comprising: a carrier bar, a plurality of electrode elements and means for securing one end-part of respective electrode elements to an outer peripheral surface of the carrier bar to form a gap-free connection between respective electrode elements and the carrier bar, said electrode elements projecting outwardly in several mutually different directions from said outer peripheral surface of said carrier bar, said electrode elements having tips that are pointed and shanks extending away from the carrier bar, the shanks of the electrode elements being grooved along at least a portion of their length.

2. An emission electrode according to claim 1, wherein said tips have a pyramidal configuration.

3. An emission electrode according to claim 1, wherein said grooved shanks of the electrode elements comprise screw-threaded shanks.

4. An emission electrode according to claim 1, wherein said electrode elements are substantially horizontally arranged when in use and said grooved shanks of the electrode elements include substantially vertically arranged grooves extending along the shanks.

5. An emission electrode according to claim 1, wherein the carrier bar has a rectangular cross-section and is solid.

6. An emission electrode according to claim 1, wherein end-parts of the carrier bar are provided with means for attaching the emission electrode to holder devices.

7. An emission electrode according to claim 1, wherein the carrier bar has a rectangular cross-section and is hollow.

8. An emission electrode according to claim 1, wherein the emission electrodes are fused to the carrier bar.

9. An emission electrode according to claim 1, wherein the emission electrodes are stud-welded to the carrier 10. An emission electrode according to claim 1, wherein said tips have a conical configuration.

11. An emission electrode according to claim 10, wherein said grooved shanks of said electrode elements comprise screw-threaded shanks.

12. An emission electrode according to claim 11, wherein the carrier bar has a rectangular cross-section and is solid.

13. An emission electrode according to claim 12, wherein end-parts of the carrier bar are provided with means for attaching the emission electrode to holder devices.

14. An emission electrode according to claim 12, wherein the carrier bar has a rectangular cross-section and is hollow.

* * * * *

UNITED STATES PATENT AND TRADEMARK OFFICE

CERTIFICATE OF CORRECTION

PATENT NO. : 5,125,936

DATED : June 30, 1992

INVENTOR(S) : Johansson

It is certified that error appears in the above-identified patent and that said Letters Patent is hereby corrected as shown below:

In column 5, line 11, after "carrier" insert --bar.--.

Signed and Sealed this

Twenty-eighth Day of September, 1993

Bruce Lehman

*Attest:*

BRUCE LEHMAN

*Attesting Officer*

*Commissioner of Patents and Trademarks*